US007121487B2

(12) United States Patent
Cohen et al.

(10) Patent No.: US 7,121,487 B2
(45) Date of Patent: Oct. 17, 2006

(54) SCREENING APPARATUS WITH HAMMERMILL

(75) Inventors: Douglas J. Cohen, Bexley, OH (US); Steven A. Cohen, Blacklick, OH (US)

(73) Assignee: Ohio Central Steel Company, Reynoldsburg, OH (US)

( * ) Notice: Subject to any disclaimer, the term of this patent is extended or adjusted under 35 U.S.C. 154(b) by 168 days.

(21) Appl. No.: 10/651,266

(22) Filed: Aug. 28, 2003

(65) Prior Publication Data

US 2005/0045052 A1 Mar. 3, 2005

(51) Int. Cl.
*B02C 23/10* (2006.01)

(52) U.S. Cl. ..... 241/79.3; 241/283; 241/284; 241/285.3; 241/287; 241/289; 241/290

(58) Field of Classification Search ..... 241/32, 241/79.3, 238, 285.3, 287, 289, 290; 209/284
See application file for complete search history.

(56) References Cited

U.S. PATENT DOCUMENTS 5,427,250 A 6/1995 Page et al.
5,593,096 A * 1/1997 Harker et al. ..... 241/14
5,722,605 A * 3/1998 Finken ..... 241/32
5,819,950 A 10/1998 McCloskey
6,095,442 A * 8/2000 Doelle ..... 241/74
6,685,118 B1 * 2/2004 Williams, Jr. ..... 241/232

OTHER PUBLICATIONS

Author Unknown; "The Screen Machine Multi-Blend 1" (5 pgs); remainder unknown.

* cited by examiner

*Primary Examiner*—Lowell A. Larson
*Assistant Examiner*—Jason Y Pahng
(74) *Attorney, Agent, or Firm*—Jason H. Foster; Kremblas, Foster, Phillips & Pollick

(57) ABSTRACT

A screening machine on a frame with a hopper having a conveyor belt. The conveyor belt discharges particulate material poured into the hopper into a rotating barrel screen or vibrating planar screen for sifting the material. A hammermill apparatus is pivotably mounted on a hood member to an arm that is pivotably mounted to the frame of the machine. The hammermill is positioned above the conveyor belt at the discharge end. The hammermill can pivot upwardly relative to the arm upon striking a large object on the conveyor belt, and a spring mounted to the arm and the hood biases the hammermill back to its original position. A hydraulic ram is drivingly linked to the arm for manually or automatically displacing the hammermill relative to the conveyor belt.

10 Claims, 12 Drawing Sheets

SCREENING APPARATUS WITH HAMMERMILL

(e) BACKGROUND OF THE INVENTION

1. Field of the Invention

This invention relates generally to an apparatus for separating according to size a quantity of particulate material that contains various sizes of particles, and more particularly relates to an apparatus with at least one moving screen that separates particulate material according to size by the particulate falling through the screen or screens.

2. Description of the Related Art

Moving screens are used to sort material by size in various industries including mining, construction, waste disposal, landscaping and demolition. Some screens are substantially planar and vibrate at least partially in a direction transverse to the plane of the screen. Material placed on the screen vibrates with the screen and the particles that are smaller than the openings in the screen fall through and collect beneath the screen or are conveyed to a location spaced from the screen, such as by a chute and/or conveyor belt.

Other screens are not planar but are cylindrical, and these screens are called barrel or "trommel" screens. Barrel screens have at least one screen that is cylindrically shaped to form a cage-like screening structure. The barrel screen's longitudinal axis is angled relative to horizontal during use, and the barrel screen is rotated about its longitudinal axis. The material to be processed is placed in the open mouth of the higher end and the rotation and the angled axis cause the material to tumble toward the lower end with smaller, screened material falling down through the apertures of the screen. The material that does not pass through the screen is discharged out of the open mouth of the lower end. The screened material can accumulate on the ground below the barrel screen or can fall onto a conveyor belt or chute that is positioned to catch the material and convey it out from beneath the screen. Likewise, the material that passes out of the lower end of the barrel screen can fall on the ground or be conveyed away on a chute or conveyor belt.

A typical barrel screen apparatus has a barrel screen with a length that is greater than its diameter, and a conveyor belt that is aligned lengthwise beneath the barrel. The lengthwise conveyor extends out the front or the rear of the apparatus, or a lateral conveyor receives the material from the lengthwise conveyor and conveys it laterally at any position intermediate the two ends of the apparatus or at one of the two ends. Other barrel screen apparatuses have different barrels and permit the screened material to fall onto the ground below the barrel.

Portable barrel screening machines are known in the prior art. Conventional portable barrel screening machines have an input conveyor, a rotary barrel screen and a longitudinal conveyor beneath the barrel screen, all of which are mounted together on frame. The frame is provided with wheels at one end and a "fifth wheel" at the opposite, for connection to a conventional semi-tractor vehicle or is mounted on tracks. Other conventional barrel screening machines have a planar screen followed by a first conveyor that receives the material that passes through the planar screen, a barrel screen that receives the material from the first conveyor and a second conveyor that receives the material that falls through the barrel screen and conveys it away from the barrel.

The material that is to be screened by conventional machines is typically fed into the receiving end of a barrel screen by a conveyor belt, onto which material is dumped. The material that is first poured onto the conveyor is not always processed prior to entering the barrel screen. If the material is processed before entering the barrel screen, it is processed by a large planar screen or a hammermill, followed by a conveyor that conveys the pre-screened material into the barrel screen as described above.

The prior art configurations have the disadvantage that the length required for the apparatus is large. If the material is not pre-processed, the barrel screen must be very long to sufficiently screen the charge of particulate. Alternatively, if the material is pre-processed by a planar screen or a hammermill, the entire apparatus is especially long due to the second conveyor's length. These long machines cannot be transported easily over the road. Therefore, the need exists for a screening machine that is effective, but can be transported easily.

(f) BRIEF SUMMARY OF THE INVENTION

The invention is a screening apparatus, a preferred embodiment of which is a barrel screening apparatus. The apparatus includes a frame, which is a supporting structure of rigid, preferably steel, members to which the rest of the apparatus is mounted.

A hopper is mounted to the frame, and is for receiving particulate material to be screened. The hopper has a discharge end from which particulate material received by the hopper and conveyed in a particulate stream is discharged. A barrel screen is rotatably mounted to the frame, and the barrel screen has an output end and an opposite input end. The input end is positioned adjacent the hopper discharge end for receiving particulate material discharged from the hopper.

A hammermill is mounted to the frame near the hopper discharge end. The hammermill is mounted at least partially in the particulate stream, and operates to reduce the size of the particulate material prior to discharge of the particulate material to the input end of the barrel screen. The preferred hammermill has hammers that are mounted radially to an axle that is rotated with the hammers at least partially in the particulate stream, thereby striking the particulate material in the particulate stream and reducing its size.

In a preferred embodiment, the hopper has a sidewall extending around and above a hopper conveyor. During operation, the hopper conveyor conveys the particulate material along the particulate stream in the hopper to the hopper discharge end and into the input end of the barrel screen. The hammermill is also mounted above the hopper conveyor in the preferred embodiment, and the hammermill is mounted at least partially within the input end of the barrel screen.

In a most preferred embodiment, an arm is pivotably mounted to the frame near a first arm end and pivotably mounted to the hammermill near a second arm end. A spring is mounted at a first spring end to the hammermill and connected at a second spring end to the arm for biasing the hammermill toward the hopper conveyor. The hammermill's pivotable mounting permits upward pivoting of the hammermill away from the hopper conveyor during operation of the hammermill to accommodate obstructions in the particle stream. The spring returns the hammermill to its original position.

The arm is drivingly linked to a prime mover, such as a hydraulic ram, that is mounted to the frame for displacing the hammermill relative to the hopper conveyor during operation of the hammermill. The hydraulic ram adjusts the position of the hammers of the hammermill above the hopper conveyor, thereby adjusting the depth of particulate matter on the hopper conveyer that is struck by the hammers.

(g) BRIEF DESCRIPTION OF THE SEVERAL VIEWS OF THE DRAWINGS

Figure 1:
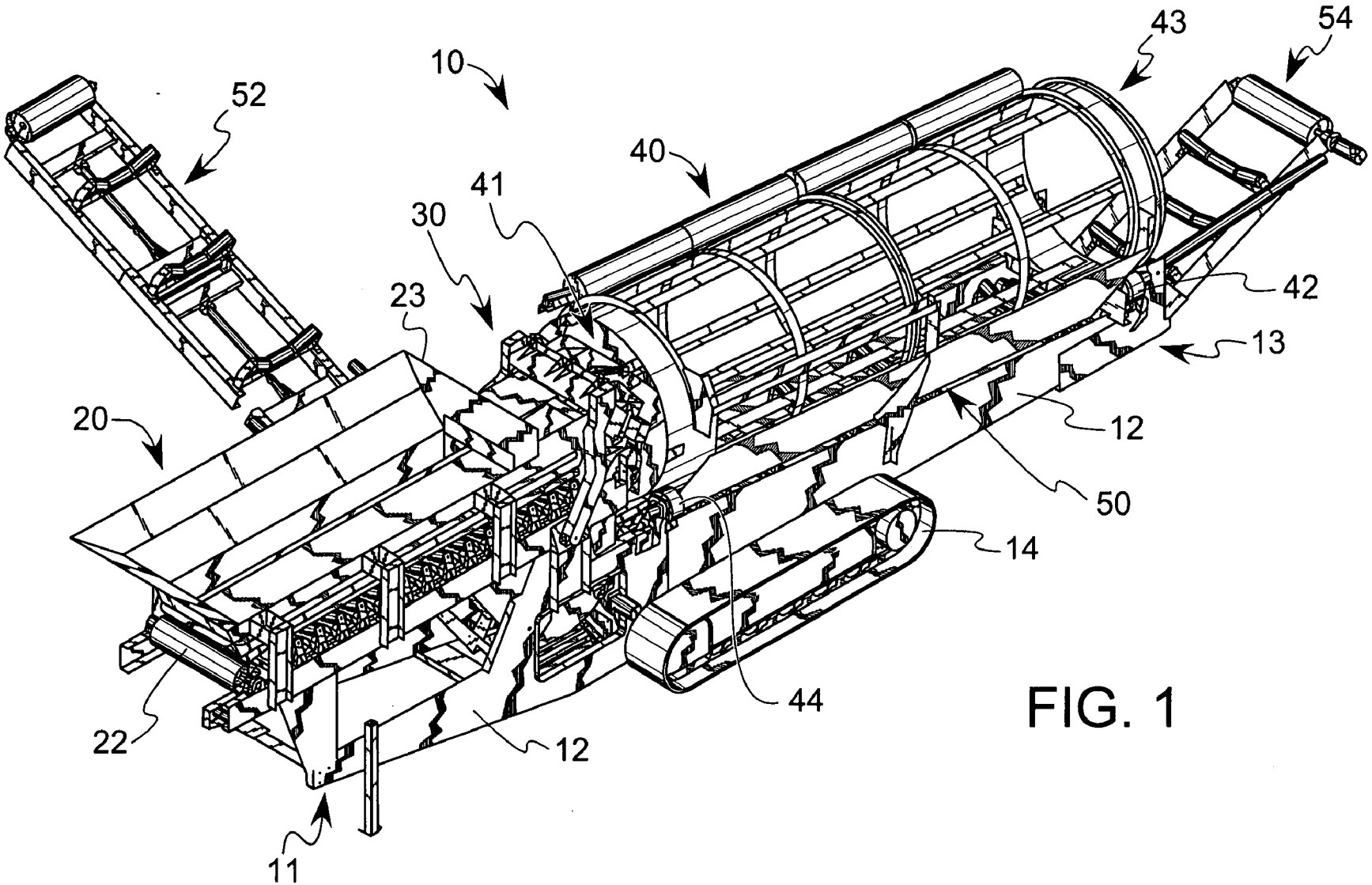
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

(h) DETAILED DESCRIPTION OF THE INVENTION

The portable screening apparatus 10 is shown in FIG. 1. The screening apparatus 10 has a frame 12 made up of rigid, preferably steel, structural members to which the other components of the apparatus are mounted. The frame 12 is mounted on a pair of substantially identical endless tracks 14 and 16 (not shown) which are drivingly linked to a motor in a conventional manner to form driving means similar to that found on conventional portable screening machines and other construction equipment, such as bulldozers and trackhoes. Other driving means, including pneumatic tires, can be substituted for the endless tracks, and it is also possible for the apparatus to be without driving means, and simply have passive structures, such as wheels and a hitch or skids, which require a bulldozer, a tractor-trailer or other vehicle to push or pull the screening apparatus. A non-portable, static screening apparatus according to the present invention is also contemplated.

A hopper 20 is mounted at one end of the frame 12 and has at least one sidewall, preferably a plurality of inclined sidewalls connected at corners to form a "funnel" structure that directs material poured into the hopper 20 inwardly and downwardly. A conventional conveyor belt 22 is positioned beneath the lower edges of the sidewalls of the hopper 20 to receive particulate material that is poured into the hopper 20 and convey the material along the frame 12. The conveyor belt 22 conveys the material from the upstream end 11 of the frame 12 to which the hopper 20 is mounted toward the opposite, downstream end 13. The material poured into the hopper 20 is thus conveyed from the upstream end 11 of the frame 12 toward the discharge end 23 of the hopper 20 in a particle stream. The term "particle stream" is defined herein as the path that the particulate matter follows when it is conveyed along at least some portion of the length of the apparatus 10. At some positions, the particle stream rests on conveyor belts, at other positions the particle stream falls through the air from one surface onto another.

The type of material that is contemplated to be poured in the hopper 20 is similar to the type of material that is commonly screened by conventional screening plants and is referred to herein as particulate matter or material. For example, such particulate material can include a mixture of soil, sand, gravel, asphalt pavement, concrete, trash, mulch, lumber, branches and other forms of wood, and any other particles, larger or smaller than those listed, that are desirably separated according to particle size. Particulate matter includes particles clumped together, such as soil.

Figure 2:
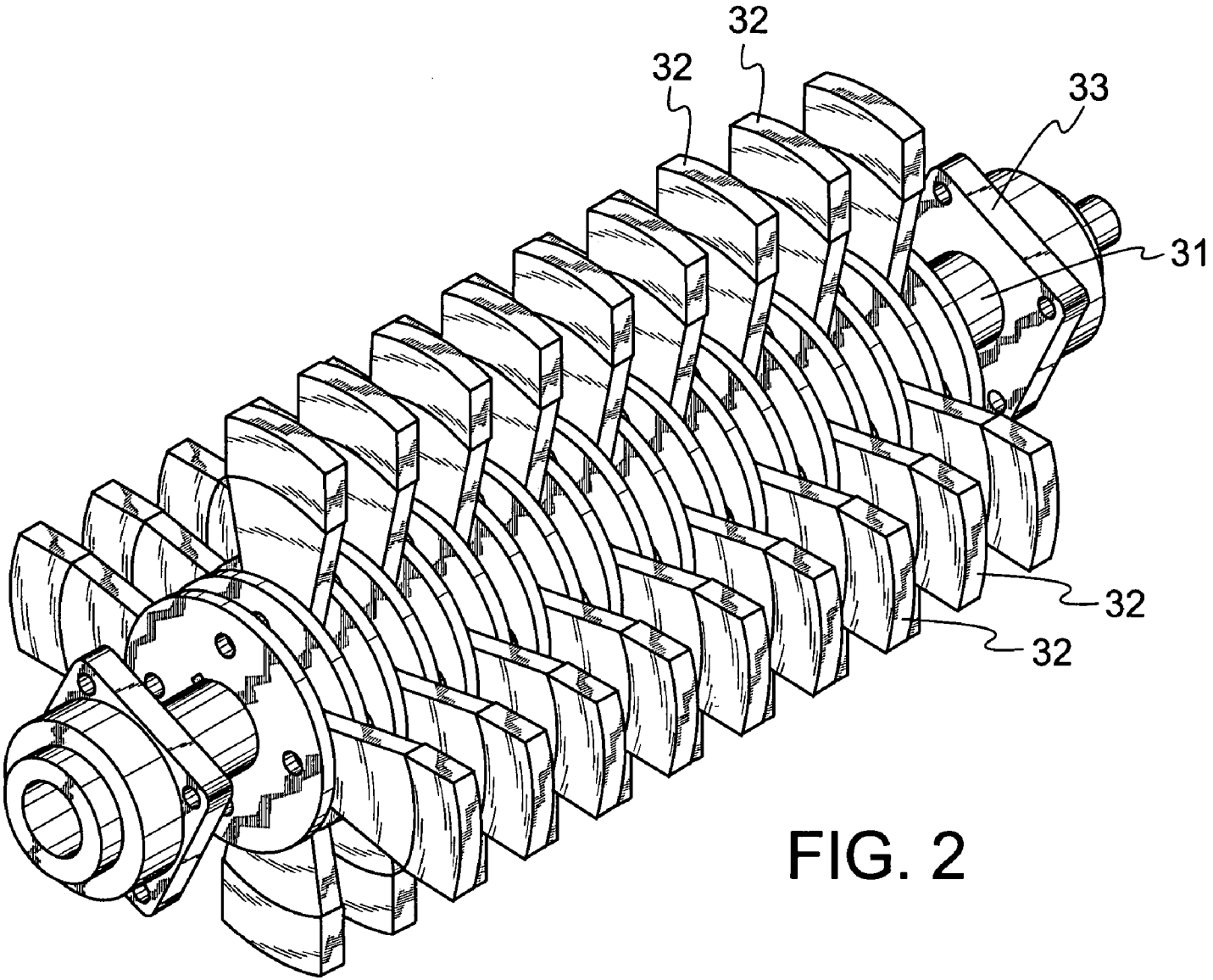
FIG. 2 is a view in perspective illustrating the preferred hammermill.

A hammermill apparatus 30 is mounted at the discharge end 23 of the hopper 20. The hammermill apparatus 30 has a cylindrical axle 31 journalled in a bearing 33, and a plurality of preferably radial hammers 32 preferably pivotably mounted to the axle 31, as shown in FIG. 2, and disposed above the conveyor belt 22 in an operable orientation. The axle 31 is rotatably driven, for example by a hydraulic motor 131 (shown in FIG. 9) about an axis of rotation coincident with the axle's 31 axis.

The hammers 32 are positioned above the conveyor belt 22 in the stream of particles during operation, revolve rapidly around the axle 31, and strike material in the particle stream being conveyed down the conveyor belt 22. The hammermill apparatus 30 thereby breaks larger particles of material into smaller particles and reduces the size of any chunks of collected particles, such as clumps of soil. The hammermill apparatus 30 thus pre-processes the particulate material before it is screened.

At the discharge end 23 of the hopper 20, the conveyor belt 22 extends above the frame and into the barrel screen 40 in the manner of a cantilever to pour material from the hopper 20 into the barrel screen 40. The barrel screen 40 is a conventional barrel screen, and it is inclined relative to horizontal so that its raised, input end 41 is higher than its output end 43. The barrel screen 40 is rotatably mounted about its axis and rests upon rollers, such as the rollers 42 and 44, which support, and impart rotary motion to, the barrel screen 40. Particulate material poured into the input end 41 by the discharge end of the conveyor belt 22 tumbles down the rotating barrel screen 40, and during the tumbling any particles smaller than the openings in the cylindrical screen of the barrel screen 40 fall through and onto the underscreen conveyor belt 50. Material which is too large to pass through the barrel screen 40 falls onto the conveyor 54 at the downstream end 13, and the conveyor 54 conveys the material longitudinally away from the frame 12. Of course, the material could fall on the ground or a chute instead of the conveyor 54.

The preferred underscreen conveyor 50 conveys the screened material back toward the upstream end 11 of the frame 12. Near the discharge end 23 of the hopper 20, the lateral conveyor 52 receives the material from the underscreen conveyor 50 and conveys it laterally of the frame 12. Alternatively, an underscreen conveyor could be configured another way, for example to convey material that falls through the barrel screen 40 all the way to the upstream end 11, or toward the downstream end 13. Still further, there could be no underscreen conveyor, and the particles could fall onto the ground beneath the barrel screen 40, or there could be a chute that directs the particles to the side or end of the barrel screen 40.

Figure 3:
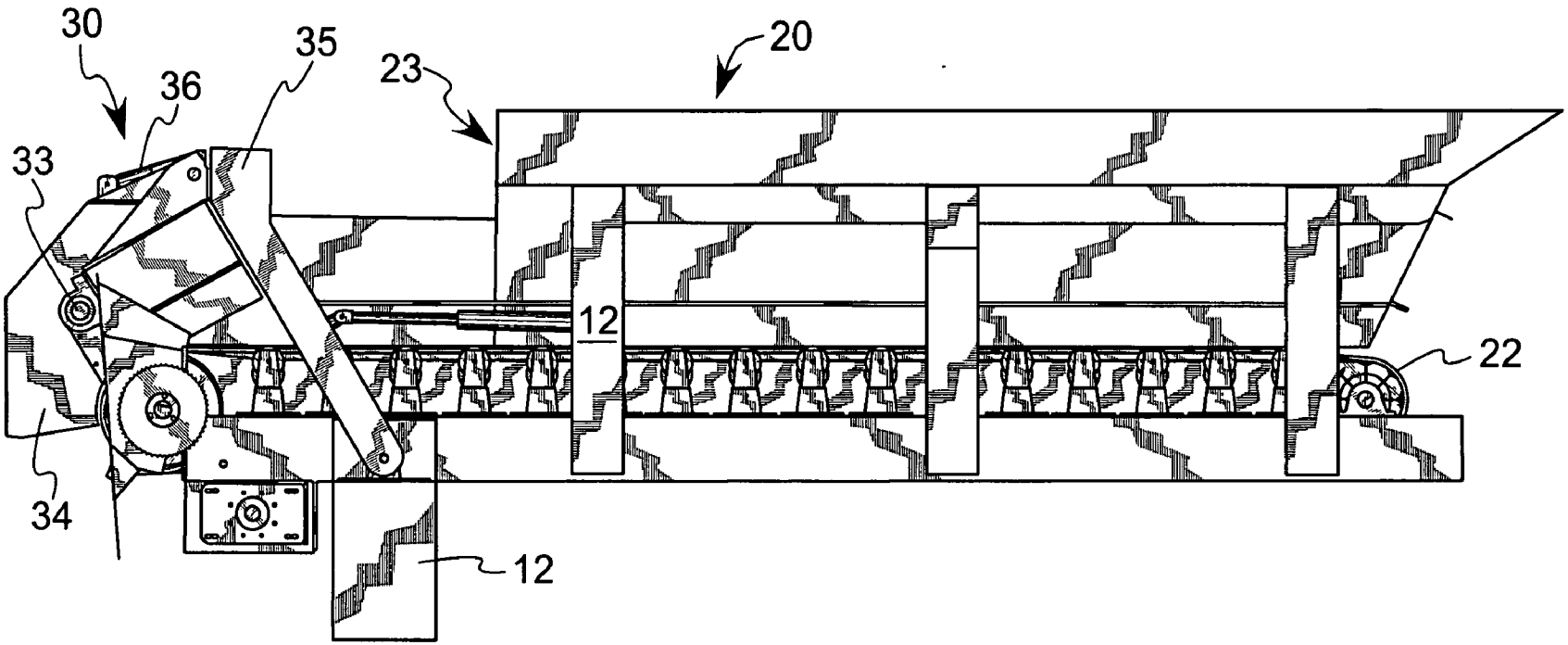
FIG. 3 is a side view illustrating a portion of the preferred embodiment of the present invention with the hammermill in a first position.
Figure 9:
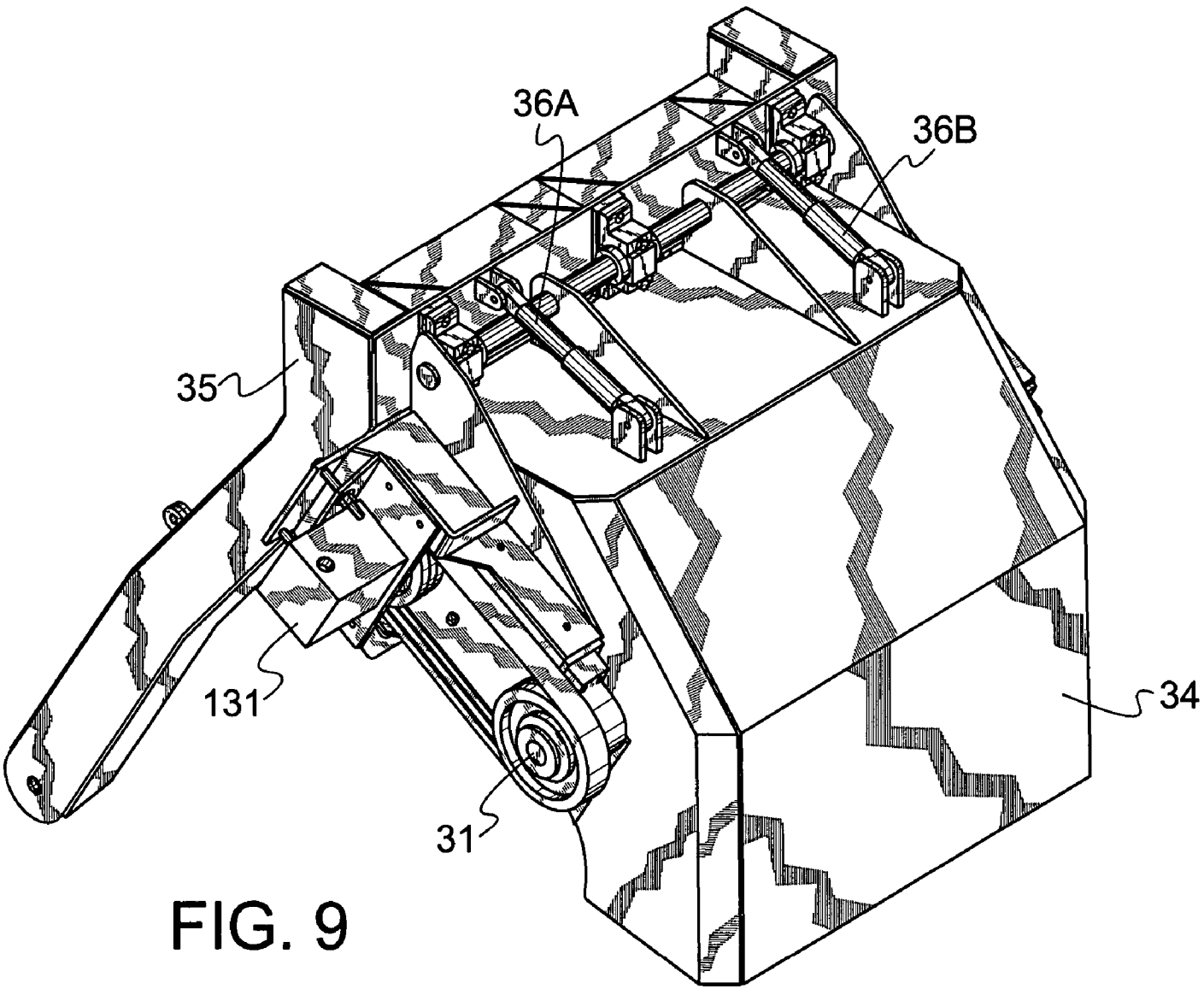
FIG. 9 is a view in perspective illustrating the preferred hammermill apparatus.

Referring to FIGS. 3 and 9, the hammermill apparatus 30 has a member, preferably the hood 34 but alternatively any structural member capable of supporting the hammermill, that is pivotably mounted at its upper end to the arm 35. The arm 35 is pivotably mounted at its lower end to the frame 12. The hood 34 thus connects to the frame 12 through the arm 35, but could attach directly to the frame 12 in a simpler embodiment. The axle 31, with the attached hammers 32, is rotatably mounted to the hood 34, to which the bearing 33 is mounted, in order to permit substantially unrestricted rotation of the axle 31 relative to the hood 34. The hood 34 is thus a rigid member that is connected to the frame 12 through the arm 35 to permit movement of the hammermill apparatus 30 relative to the frame 12 as described below. The hood 34 is able to pivot about the upper end of the arm 35 by compressing the spring and shock-absorber combinations 36*a* and 36*b*, which are pivotably mounted at their opposite ends to the hood 34 and the arm 35. The combinations 36*a* and 36*b* have springs which bias the hood 34 to its original position after they are compressed, although gravity could be used as the "spring" to return the hood 34. Additionally, the combinations 36*a* and 36*b* contain dampers that prevent the hood 34 from bouncing by dissipating some energy, such as by friction.

Figure 4:
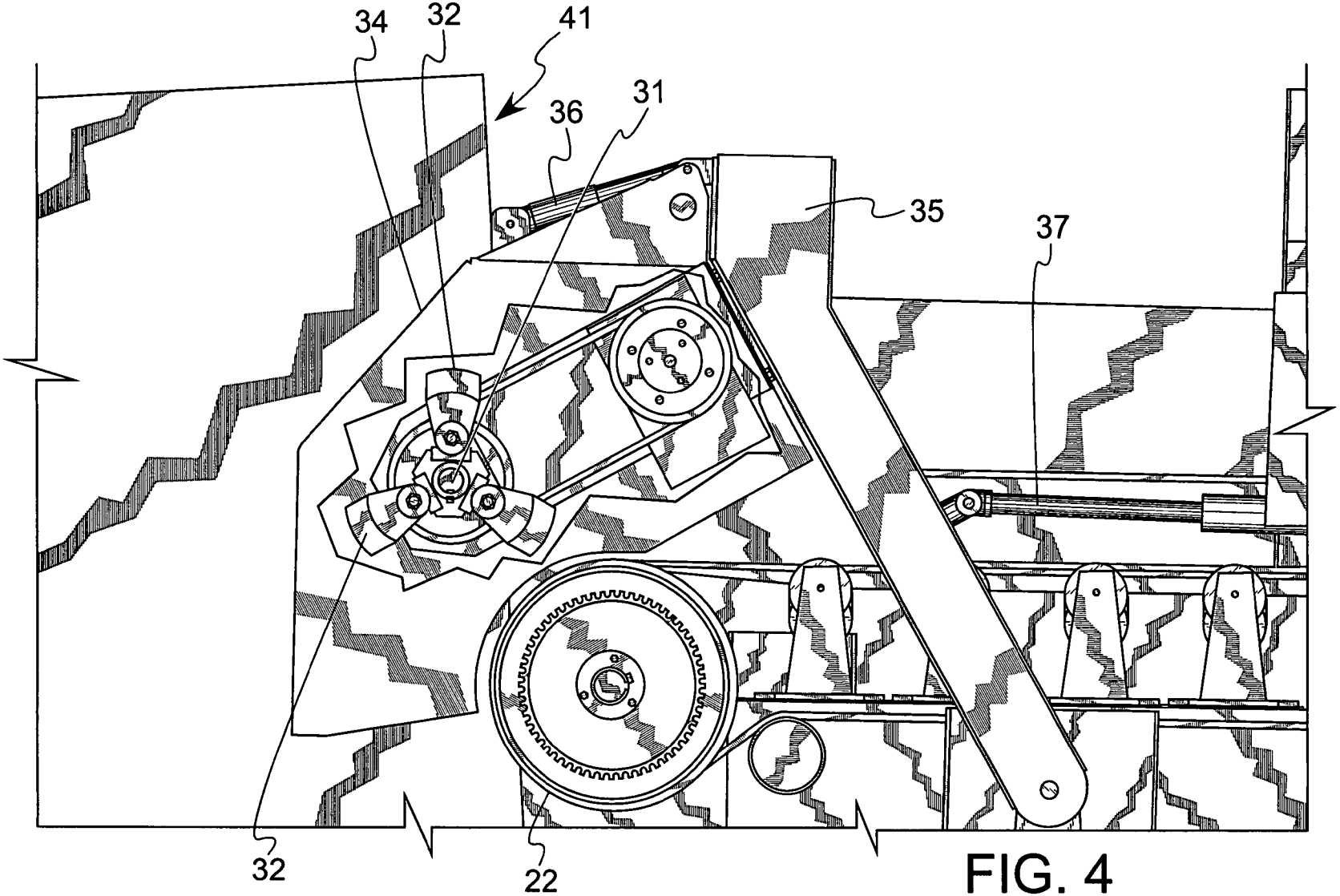
FIG. 4 is a close-up side view illustrating a portion of the preferred embodiment of the present invention with the hammermill in the first position.

The peripheral ends of the hammers 32 are positioned, in the preferred operable position, a predetermined distance from the conveyor belt 22, as shown in FIG. 4, within the particle stream. This distance can be between a fraction of an inch and several inches, depending upon many factors, such as the material type, the maximum size of the material particles, the length of the hammers 32, and many other factors that will be apparent to the person of ordinary skill from the description herein. Also, although the hammermill apparatus 30 is above the conveyor belt 22, it could be in the particle stream but not directly above the conveyor belt 22.

As shown in more detail in FIG. 4, a prime mover, preferably the hydraulic ram 37, is pivotably mounted at one end to the arm 35 and pivotably mounted at the opposite end to the frame 12. Upon actuation of the ram 37, the arm 35 pivots about the frame 12, thereby raising and lowering the hammermill apparatus 30 relative to the conveyor belt 22. The distance between the hammers 32 and the conveyor belt 22 can therefore be changed during operation of the hammermill apparatus 30, which is while the axle 31 is rotating and the hammers 32 are within the particle stream.

Figure 5:
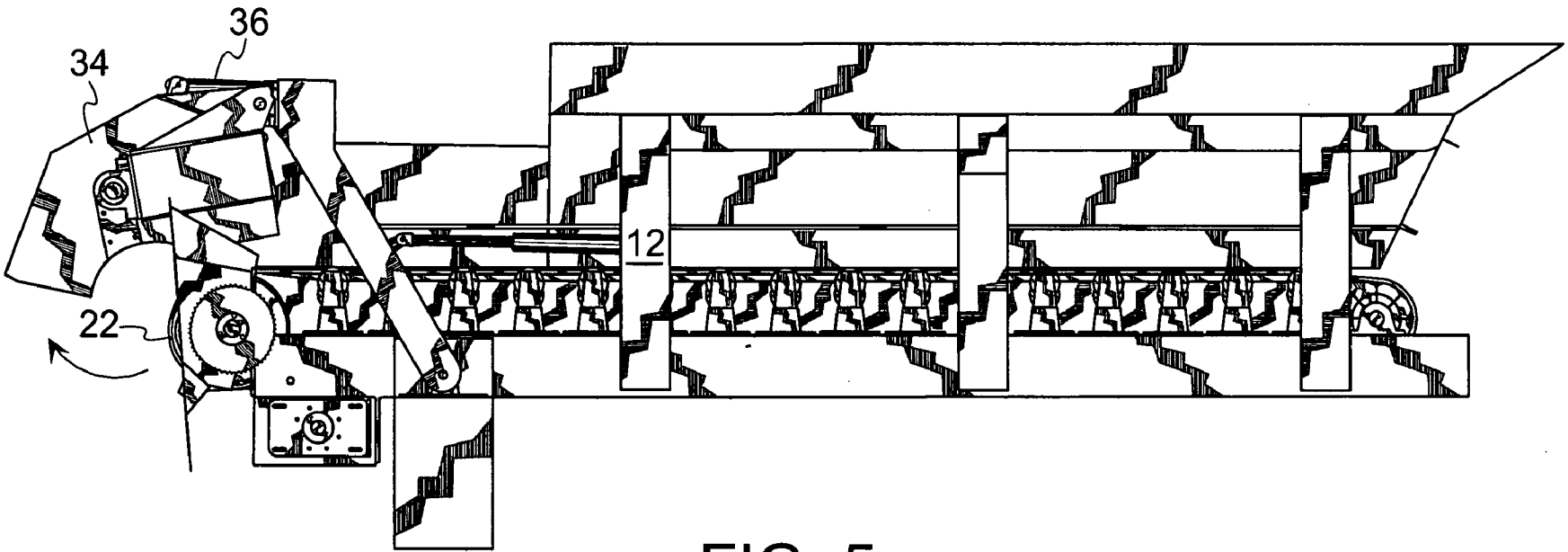
FIG. 5 is a side view illustrating a portion of the preferred embodiment of the present invention with the hammermill in a second position.

The distance between the hammers and the conveyor belt 22 can be changed in one or both of two types of relative movement. In the first type of relative movement an obstruction, such as a large object, is in the particle stream, and that obstruction is conveyed into the hammers 32. Because the obstruction is difficult for the hammers 32 to break apart, the force of the hammers 32 striking the object exerts an upward force on the hood 34 that compresses the spring and shock combinations 36*a* and 36*b*. This upward force is due to the fact that the hydraulic motor 131 rotates the axle 31 preferably in a direction that causes the hammers 32 to swing over and into the top of the oncoming stream of particles supported on the conveyor belt 22. Thus, a large object in the particle stream is struck by hammers 32 when the hammers are on the downswing of their rotation. This causes the hammers 32 to tend to pivot upwardly about the contact point with the object, which exerts an upwardly directed force against the axle 31. The hood 34 is thus forced upwardly and pivots about its pivot connection to the arm 35. This upward motion is relative to the arm 35, and compresses the spring and shock combinations 36*a* and 36*b*. The hood 34 is shown in its upper, deflected position in FIGS. 5 and 6.

The first type of relative movement would commonly happen, for example, when a tree stump or a large concrete block is conveyed by the conveyor belt 22 along with a load of gravel and dirt. The ability of the hood 34 to be deflected upwardly in response to the striking of an obstruction is a safety feature that preserves the lifespan of the hammers 32 and increases efficient operation by permitting the large object to pass by the hammermill apparatus 30 and into the barrel screen 40, rather than backing up into the hopper and creating a blockage in the particle stream.

Figure 7:
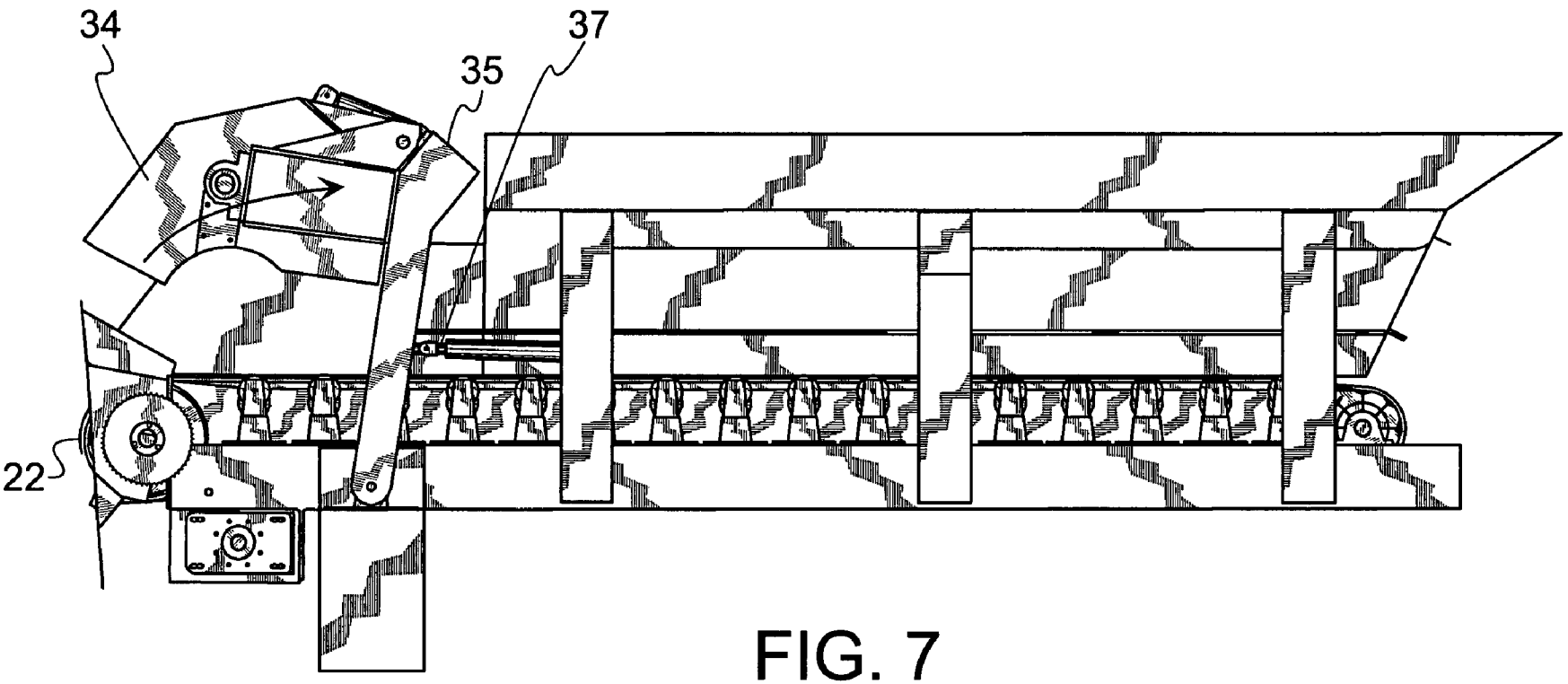
FIG. 7 is a side view illustrating a portion of the preferred embodiment of the present invention with the hammermill in a third position.
Figure 8:
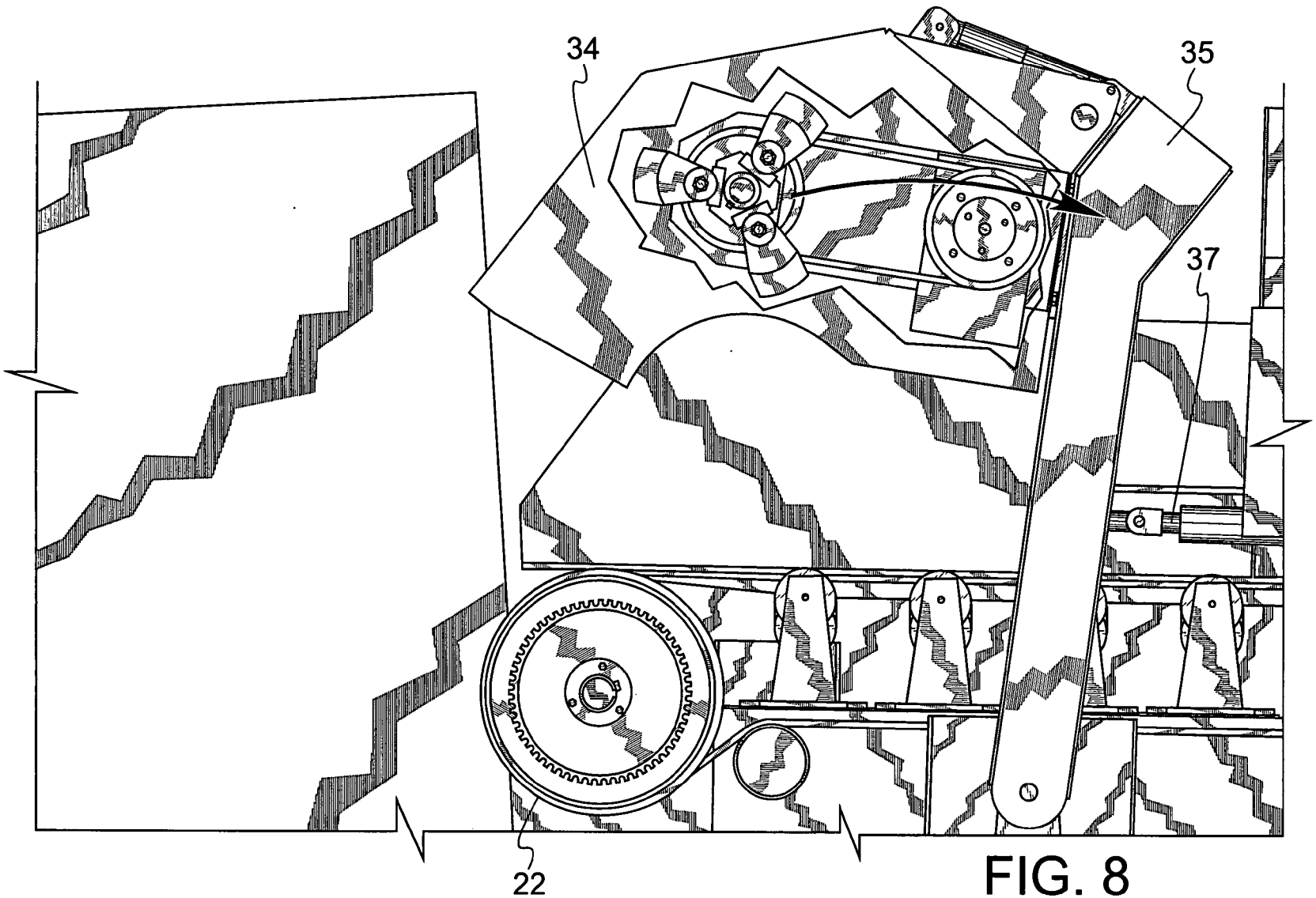
FIG. 8 is a close-up side view illustrating a portion of the preferred embodiment of the present invention with the hammermill in the third position.

In the second type of relative movement, the arm 35 is pivoted upwardly about the pivot point at the arm's 35 lower end by actuating the hydraulic ram 37. The arm 35, and the connected hammermill apparatus 30, are illustrated in FIGS. 7 and 8 in the retracted position when they are displaced in a downstream direction from their original position shown in FIGS. 3 and 4. Upon actuation of the hydraulic ram 37 in the opposite direction, the arm 35 is displaced back to its original position, or to any position between the position shown in FIGS. 7 and 8 and the position shown in FIGS. 3 and 4, in which the hammers 32 are only a small distance above the conveyor belt 22.

This second type of relative movement can be actuated manually, such as by an operator who desires to adjust the distance between the hammers 32 and the conveyor belt 22 or to permit large objects to pass by the hammermill apparatus 30 as they are noticed. This movement can also be actuated automatically, such as by a sensor that senses a force applied to the hood 34 and then actuates the hydraulic ram 37. Any suitable sensor or detecting means could be used, as will be understood by a person of ordinary skill.

Although it is possible for each type of relative movement to occur separately, it is also possible for both types of relative movement to occur simultaneously. For example, it is contemplated that an obstruction, such as a concrete slab, could be conveyed on the conveyor belt 22. Upon striking the obstruction, the hood 34 would pivot upwardly and the slab would begin to pass beneath the hammers 32. Additionally, either manually or automatically, the hydraulic ram 37 can be actuated to raise the hammermill higher above the conveyor belt 22 to permit the entire slab to pass through without the hammers 32 continuing to strike the slab, which would be the case if the concrete slab became stuck beneath the hammermill or passed slowly beneath the hammermill. Thus, the hammermill apparatus can be moved relative to the conveyor belt 22 by movement of the hood 34 relative to the arm 35, and by movement of the hood 34 and the arm 35 relative to the frame 12, and both simultaneously.

The screening machine 10 operates to screen material poured into the hopper 20 in the following manner. The material poured into the hopper 20 is conveyed downstream in a particle stream by the conveyor belt 22, which discharges the material directly into the input end 41 of the barrel screen 40. Just upstream of the entrance of the material into the barrel screen 40, the hammers 32 of the hammermill apparatus 30 rapidly strike the material to reduce larger objects to smaller objects as described above.

Large objects in the stream of particles pass by the hammermill apparatus 30 when the hood 34 pivots upwardly relative to the arm 35, when the arm 35 and the hood 34 pivot upwardly relative to the frame 12 or when both occur. The material enters the rotating barrel screen 40 immediately after passing through the hammermill apparatus 30, and is screened in the barrel screen 40 in a conventional manner. Screening in the barrel screen 40 is more rapid due to the pre-processing of the material by the hammermill apparatus 30. Smaller particulate material falls through the barrel screen 40 and onto the underscreen conveyor 50, which conveys the material upstream beneath the barrel screen 40 onto the lateral conveyor 52. Larger material that does not fall through the barrel screen 40 is discharged out of the output end 43 and onto the conveyor 54.

Figure 10:
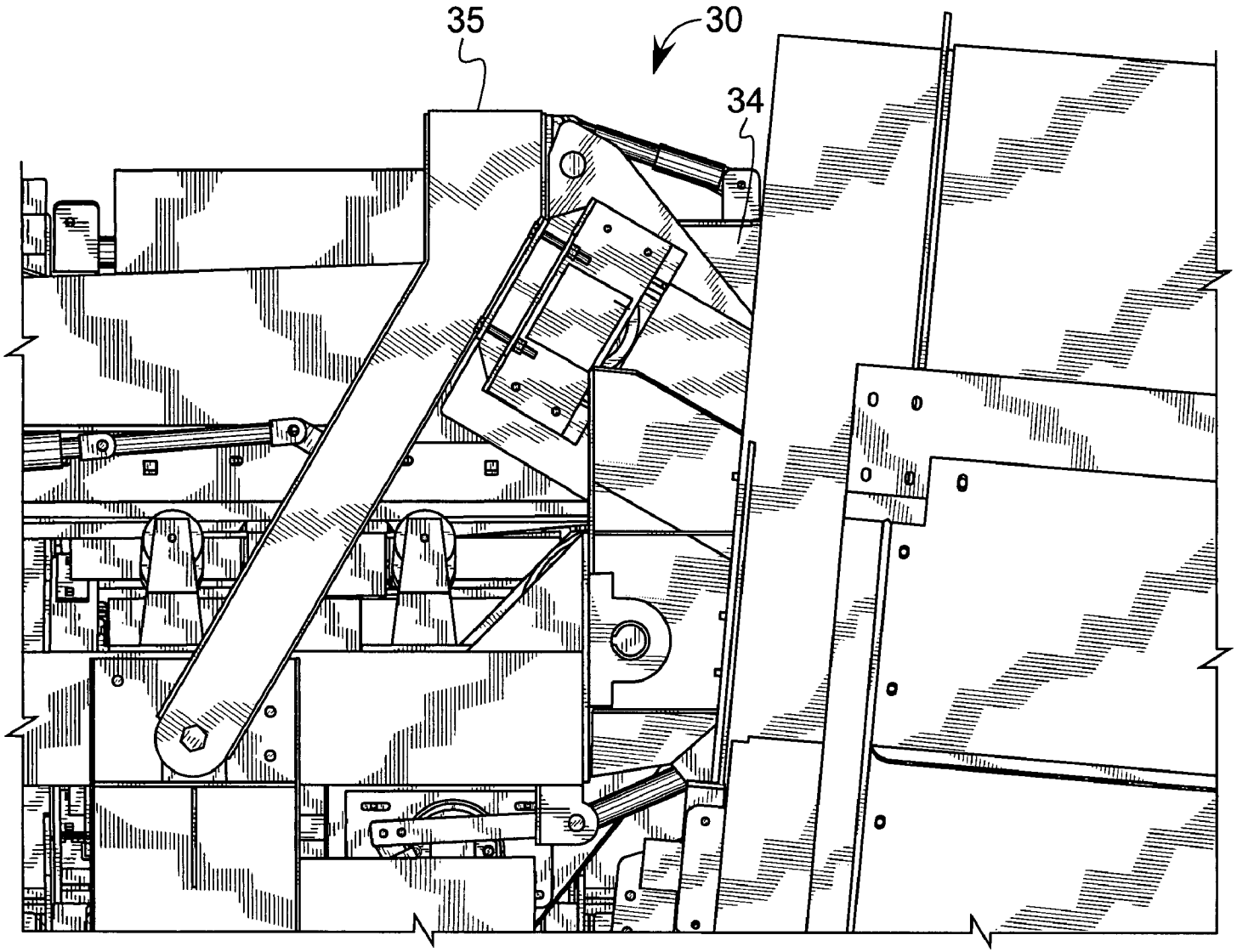
FIG. 10 is a side view illustrating a portion of the preferred embodiment of the present invention.
Figure 11:
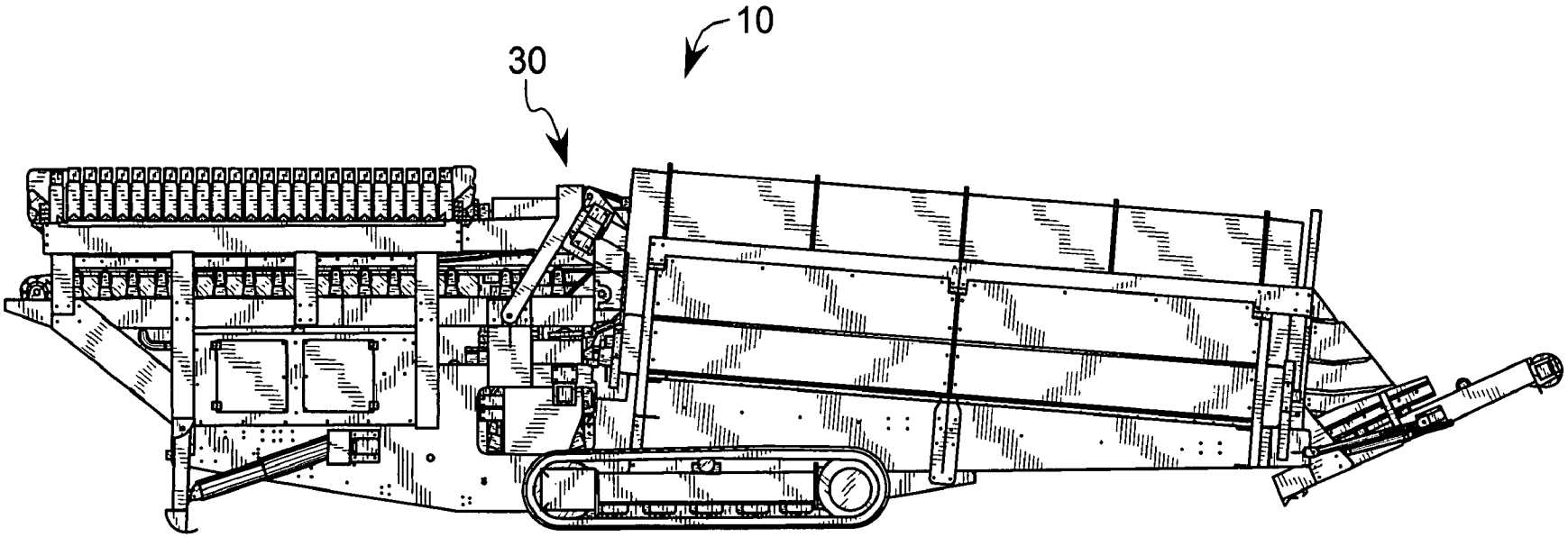
FIG. 11 is a side view illustrating the preferred embodiment of the present invention.

As shown in FIGS. 4 and 10, at least part of the hammermill apparatus 30 is positioned inside of the input end 41 of the barrel screen 40. This positioning assures that the material at the discharge end 23 of the hopper 20 is processed by the hammermill apparatus 30 immediately prior to entering, or just upstream of its contact with, the barrel screen 40. Because no other structure is interposed between the hammermill apparatus 30 and the barrel screen 40, two advantages arise. First, the length of the machine is as short as possible due to the avoidance of an interposed structure, such as another conveyor. Second, the length of the barrel screen 40 required to sufficiently screen the material is as short as possible, due to the pre-processing that occurs due to the material already passing through the hammermill apparatus 30 before entering the barrel screen 40.

Figure 6:
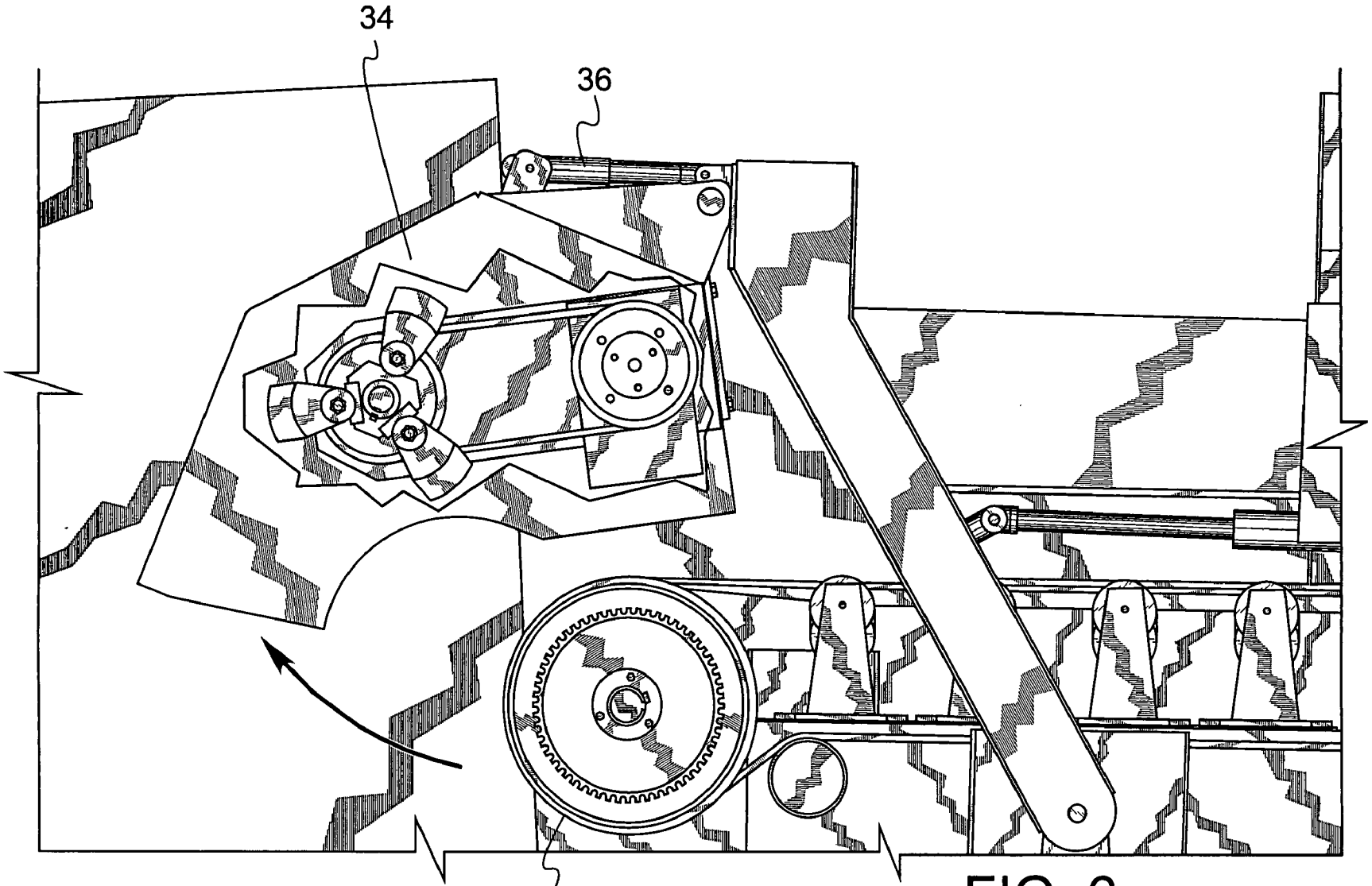
FIG. 6 is a close-up side view illustrating a portion of the preferred embodiment of the present invention with the hammermill in the second position.
Figure 12:
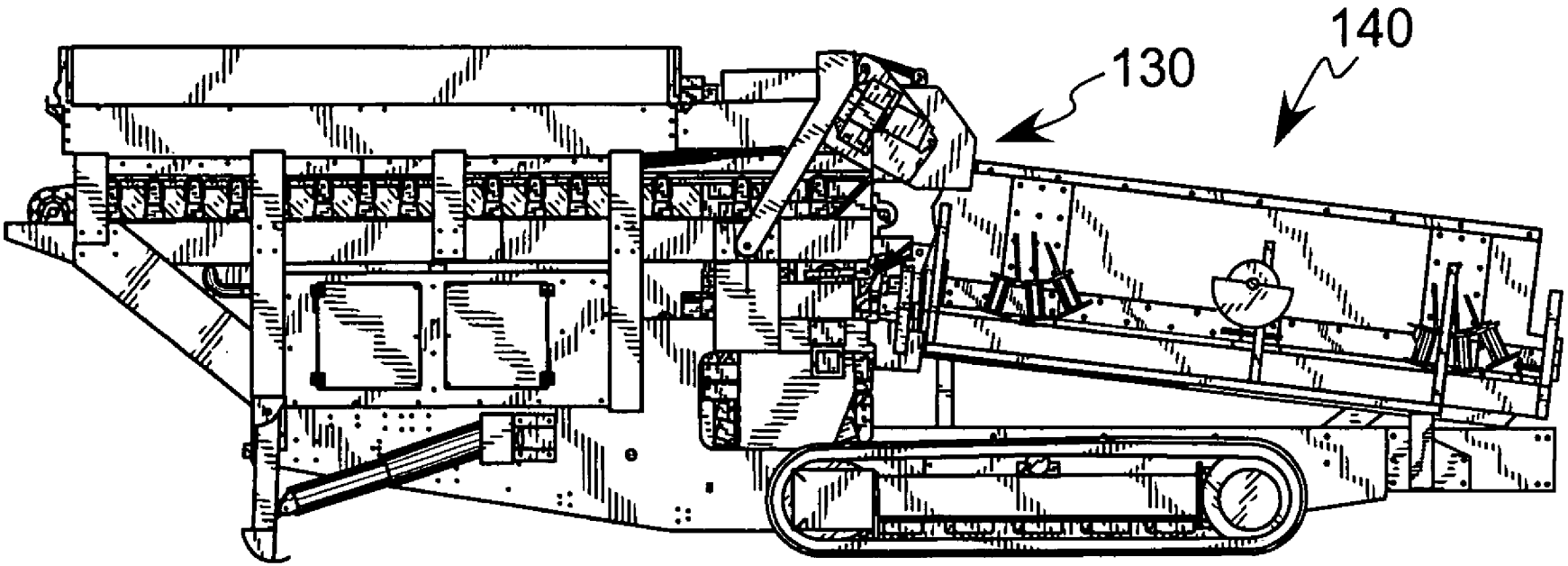
FIG. 12 is a side view illustrating an alternative embodiment of the present invention.

As is apparent from FIG. 6, raising of the hood 34 does not impact the barrel screen 40, nor does rotating the arm 35 downstream as shown in FIG. 8. Furthermore, it is possible to use the preferred hammermill apparatus 130 just upstream of a planar vibrating screen 140, as shown in FIG. 12.

While certain preferred embodiments of the present invention have been disclosed in detail, it is to be understood that various modifications may be adopted without departing from the spirit of the invention or scope of the following claims.

The invention claimed is:

1. A barrel screening apparatus comprising:

(a) a frame;

(b) a hopper for receiving particulate material to be screened, the hopper being mounted to the frame and having a hopper discharge end from which particulate material received by the hopper and conveyed in a particulate stream is discharged;

(c) a barrel screen rotatably mounted to the frame inclined relative to horizontal with an output end and an opposite input end having an opening that is substantially horizontally facing and positioned adjacent the hopper discharge end for receiving particulate material discharged from the hopper; and (d) a hammermill mounted near the hopper discharge end and at least partially in the particulate stream for reducing the size of the particulate material prior to discharge of the particulate material to the input end of the barrel screen, wherein hammers of the hammermill are mounted at least partially within the substantially horizontally facing opening of the input end of the barrel screen with a portion of the barrel screen that forms the opening of the input end rotatably mounted over the hammers, and a portion of the barrel screen that forms the opening of the input end rotatably mounted below the hammers.

2. The barrel screening apparatus in accordance with claim 1, further comprising an underscreen conveyor positioned beneath the barrel screen to receive particulate material screened through the barrel screen.

3. The barrel screening apparatus in accordance with claim 1, wherein the hammermill is mounted to permit upward pivoting of the hammermill away from the particulate stream during operation of the hammermill.

4. The barrel screening apparatus in accordance with claim 1, further comprising at least one arm pivotably mounted to the frame and the hammermill, wherein the arm is drivingly linked to a prime mover that is mounted to the frame for displacing the hammermill upwardly during operation of the hammermill upon actuation of the prime mover.

5. The barrel screening apparatus in accordance with claim 1, wherein the hopper further comprises at least one sidewall extending at least partially around and above a hopper conveyor, the hopper conveyor being for conveying the particulate material along the particulate stream in the hopper to the hopper discharge end and into the input end of the barrel screen.

6. The barrel screening apparatus in accordance with claim 5, wherein the hammermill is disposed above the hopper conveyor.

7. A barrel screening apparatus comprising:

(a) a frame;

(b) a hopper for receiving particulate material to be screened, the hopper being mounted to the frame and having a hopper discharge end from which particulate material received by the hopper and conveyed in a particulate stream is discharged, wherein the hopper comprises at least one sidewall extending at least partially around and above a hopper conveyor, the hopper conveyor being for conveying the particulate material along the particulate stream in the hopper to the hopper discharge end and into the input end of the barrel screen;

(c) a barrel screen rotatably mounted to the frame with an output end and an opposite input end having an opening positioned adjacent the hopper discharge end for receiving particulate material discharged from the hopper; and (d) a hammermill mounted near the hopper discharge end above the hopper conveyor and at least partially in the particulate stream for reducing the size of the particulate material prior to discharge of the particulate material to the input end of the barrel screen, wherein hammers of the hammermill are mounted at least partially within the opening of the input end of the barrel screen, wherein the hammermill is mounted to permit upward pivoting of the hammermill away from the hopper conveyor during operation of the hammermill.

8. The barrel screening apparatus in accordance with claim 7, further comprising a spring mounted at a first spring end to the hammermill and connected at a second spring end to the frame for biasing the hammermill toward the hopper conveyor.

9. The barrel screening apparatus in accordance with claim 7, further comprising at least one arm pivotably mounted to the frame near a first arm end and pivotably mounted to the hammermill near a second arm end, wherein the arm is drivingly linked to a prime mover that is mounted to the frame for displacing the hammermill relative to the hopper conveyor during operation of the hammermill.

10. The barrel screening apparatus in accordance with claim 9, wherein the prime mover is a hydraulic ram.

* * * * *